US006052112A

United States Patent [19]

Tanaka et al.

[11] Patent Number: 6,052,112

[45] Date of Patent: Apr. 18, 2000

[54] GRADATION DISPLAY SYSTEM

[75] Inventors: Akira Tanaka; Keiji Nunomura, both of Tokyo, Japan

[73] Assignee: NEC Corporation, Tokyo, Japan

[21] Appl. No.: 08/956,473

[22] Filed: Oct. 23, 1997

[30] Foreign Application Priority Data

Oct. 23, 1996 [JP] Japan ..... 8-280633

[51] Int. Cl.[7] ..... G09G 5/10

[52] U.S. Cl. ..... 345/147; 345/89; 345/148

[58] Field of Search ..... 345/147, 148, 345/89

[56] References Cited

U.S. PATENT DOCUMENTS

| | | | |
|---|---|---|---|
| 5,293,159 | 3/1994 | Bassetti, Jr. et al. | 345/149 |
| 5,497,172 | 3/1996 | Doherty et al. | 345/85 |
| 5,548,301 | 8/1996 | Kornher et al. | 345/85 |
| 5,619,228 | 4/1997 | Doherty | 345/148 |
| 5,731,802 | 3/1998 | Aras et al. | 345/148 |
| 5,861,869 | 1/1999 | Scheffer et al. | 345/147 |
| 5,898,414 | 4/1999 | Awamoto et al. | 345/55 |
| 5,986,640 | 11/1999 | Baldwin et al. | 345/147 |

FOREIGN PATENT DOCUMENTS

| | | |
|---|---|---|
| 0698874 | 2/1996 | European Pat. Off. . |
| 3-145691 | 6/1991 | Japan . |
| 4-211294 | 8/1992 | Japan . |
| 7-7702 | 1/1995 | Japan . |
| 7-175439 | 7/1995 | Japan . |
| 7-271325 | 10/1995 | Japan . |
| 8-254965 | 10/1996 | Japan . |
| 9409473 | 4/1994 | WIPO . |
| WO 94/09473 | 4/1994 | WIPO . |

OTHER PUBLICATIONS

Kei Takikawa, "TV Display on an AC Plasma Panel", *Trans. IECE Japan,* '77, vol. J60A, No. 1, pp. 56–62.

Akihiko Kohgami et al., "Gray–Scale Expression of TV Images on a Gas Discharge Memory Panel Display", *EICE Japan,* Technical Report, EID90–9, 1990, pp. 7–14.

K. Toda et al., "A Modified–Binary–Coded Light–Emission Scheme for Suppressing Gray Scale Disturbances of Moving Images", *ASIA Display '95,* pp. 947–948.

K. Toda et al., "Color Disturbance and Dynamic False Contour Observed in Moving Images of PDP", *IEICE,* Technical Report, EID95–136, 1996, pp. 67–72.

Patent Abstracts of Japan; vol. 97, No. 2 Feb. 28, 1997 & JP 08254965 A (Nec Corp.), Oct. 1, 1996; Abstract.

T. Yamaguchi et al: "Improvement in PDP Picture Quality by Three–Dimensional Scattering of Dynamic False Contours"; Digest of Technical Papers, Society for Information Display International Symposium, May 12–17, 1996, vol. 27 pp. 291–294 San Diego US, XP001055281; p. 294, Right–Hand Col., Line 15—Line 23; FIG. 1.

Japanese Office Action dated Oct. 20, 1998 including an English Abstract.

*Primary Examiner*—Richard A. Hjerpe
*Assistant Examiner*—Henry N. Tran
*Attorney, Agent, or Firm*—Sughrue, Mion, Zinn, Macpeak & Seas, PLLC

[57] ABSTRACT

A sub-field array is formed by providing a sub-field corresponding to an m-th bit sub-field (m and n being a positive integers of m≦n and representing the most significant bit place when m is 1) bit substantially at the center of the time axis of all the sub-field periods, and providing the other sub-fields than the m-th significant one on the opposite sides of and substantially in line symmetry with respect to the m-th significant bit sub-field. Less significant bit sub-fields are provided on the opposite sides of the close proximity of the central sub-field in the field period, and the odd and even order sub-fields are arranged in opposite sequences from one another. As the symmetrical arrangement sub-fields, odd and even scan line sub-fields are provided on the opposite sides of the central sub-field.

25 Claims, 10 Drawing Sheets

STATE "31"

STATE "32"

STATE "31"

STATE "32"

STATE "15"

STATE "16"

GRADATION DISPLAY SYSTEM

BACKGROUND OF THE INVENTION

The present invention relates to plasma or like display systems based on sub-field gradation display systems and, more particularly, to improvements in the gradation display performance in the display of moving image consisting of intermediate gradations which are obtainable from television signals or the like.

In video or computer terminal displays, the gradation display performance is very important. Among gradation display schemes are those, which are analog controlled as in a cathode-ray tube (CRT). In such a scheme, an input signal voltage is applied without being substantially deformed to a grid for electron beam current control. The light intensity of emission is determined by the magnitude of the current and substantially step-less or continuous control of the gradation display can be performed. Some gradation display schemes for plasma or like display utilize a memory effect. Such a display scheme is essentially a binary-coded display system, and requires a special gradation display method. Gradation display schemes are roughly classified into two types, i.e., analog display type and digital display type. A special method of gradation display which is utilized for plasma or like display, will now be described.

It is conceivable to increase the virtual gradation number by means of dither patterns or error dispersion as in printers, for instance. Such a scheme, however, requires a considerably fine cell structure if a desired gradation number and a desired resolution are both to be obtained, and is therefore not practical so much. A sub-field scheme is adopted as a more general scheme for binary-coded display systems. This scheme is applicable to quick response display systems such as those for plasma display. In the scheme, a video signal is quantized, and one field data thus obtained is displayed for each gradation bit on a time division basis. Specifically, one field period is split into a plurality of fields called sub-fields, which are each weighted by the number of times of light emission corresponding to each gradation bit. Such sub-fields which are obtained by the time division basis method, and are used to reproduce successive images. This scheme has resort to an integrated sight field effect for storing image over one field. Natural intermediate tone image are thus obtainable.

For realizing, for instance, 64-gradation display with this scheme, usually an input analog video signal is first quantized (or A/D converted) to obtain a light intensity signal of 6 bits individually representing successive light intensity gradation data each of double the light intensity level of that of the preceding one. The quantized video signal is stored in a frame buffer memory. Denoting the most significant bit (MSB) representing the highest light intensity by B1 and the successively less significant bits by B2 to B6, the light intensity ratios of the individual bits are 32:16:8:4:2:1. These bits are selected for the individual image elements to obtain a 64-gradation display with light intensity level gradations from level 0 to level 63.

A sub-field scheme display of a discrete scan/sustain discharge drive type, which is utilized in AC color plasma display, will now be briefly described with reference to FIGS. 10(A) to 10(B). One field period is usually set to about 1/60 second, in which no flicker can be perceived, and as shown in FIG. 10(A) it is split into six sub-fields, i.e., a 1-st to a 6-th sub-field SF1 to SF6, each consisting of a scan period and a sustain discharge period.

In the sub-field SF1, data are written in the individual image elements according to display data of the MSB B1 in the scan period. After the data have been written over the entire panel face, a sustain discharge pulse is applied to the entire panel face to cause display by light emission of the image elements, in which the data have been written. The following sub-fields SF2 to SF6 are also driven likewise. To obtain sufficient light intensity during the sustain discharge period of each sub-field, the pulse application for light emission is caused, for instances, 256 times in the sub-field SF1, and 128, 64, 32, 16 and 8 times in the following sub-fields SF2 to SF6. Basically the same sub-field driving is made in the case of merged scan/sustain discharge type driving as shown in FIG. 10(B), or the case of continuous merged scan/sustain discharge type driving over adjacent fields. Such a sub-field drive scheme is adopted because of the necessity of modulating the light intensity of emission with the number of times of light emission or the time thereof. Naturally, high speed performance of scanning and data writing in short periods of time is required to realize a plurality of times of scan in one field period. Recently, data writing performance of plasma display panels has been improved to permit data writing even in 3 microseconds or below, and 8-sub-field 256-gradation full color display has been realized.

A sub-field array constituting one field, in which the light intensity ratios are progressively reduced with time, is called a descending sequence sub-field array. On the other hand, a sub-field array in which the light intensity ratios are progressively increased with time, is called an ascending sequence sub-field array. These sub-field arrays are not special ones but have been usually used. Either sub-field array provides for satisfactory gradation display performance in still image display.

However, the use of such sub-field schemes for moving image display, results in image disturbances or defects in dependence on video. For example, with a motion of a human's face or like object, providing smoothly changing brightness in display on the screen, dark or bright gray scales appear on the image portion which are intrinsically smooth. In color display, such a motion causes generation of color deviation gray scales or scene resolution deterioration.

Specifically, where the above descending sequence sub-field array is adopted, with a motion of a human's face (which is a pattern with darker edges than a central portion), bright gray scales (hereinafter referred to as bright gray scale disturbances), not seen in the original scene, appear and proceed in the direction of the motion, and also dark gray scales (hereinafter referred to as dark gray scale disturbances) appear and proceed in the opposite direction. Where the ascending sequence sub-field array is adopted, bright and dark gray scale disturbances (which are hereinafter referred to as gray scale disturbances of moving images) are caused conversely. In color image display, the gray scale disturbances of moving images appear at different positions with the different colors because of spatially different bit digit raise points thereof. In this case, the disturbances are sometimes called color gray scale disturbances, and essentially they are generated by combinations of bright and dark gray scales in the individual colors of the color image display. This phenomenon is a cause of color deviation, resolution deterioration, etc. in the moving image display.

A CRT can essentially end the display momentarily when displaying a certain gradation level. Besides, analog data is displayed on the CRT screen with electron beam intensity modulation according to the light intensity level. On the other hand, in a plasma display or like system using the sub-field scheme for display, each gradation bit is time-division displayed slowly in a period which is nearly one field, and the viewer synthesizes by the visual sense one frame of image from the individual displayed gradation bit images with an integrating effect of the eyes. In such a state, the viewer can deviate the position of synthesis by the visual sense with his or her will by such a way as horizontally shaking the face or moving the eyesight before completion of one field of image. Moving the eyesight in random timing mostly results in deviation of the position of sub-field synthesis by the visual scene. This means that a moving image display state can be produced with a will in a still image display state. In genuine moving image display, the displayed image itself is moved with time, and motion of the viewer's eyesight is naturally caused without the viewer's will. This leads to frequent failure of completion of one field image in the field image synthesis by the visual sense. Such frequent failure of completion synthesis of one field image is thought to be a principle underlying gray scale disturbances of moving images.

To solve this problem, some schemes have been proposed. Takigawa, "TV Display on AC Plasma Panel", Trans. IECE Japan, '77/Vol. J60-A, No. 1, pp. 56–62, reports that it is effective to optimize the sub-field array such that the mean light intensity over a time corresponding to one field is reduced in error before and after the bit carry-up and -down and that in 5-bit, i.e., 32-gradation, display an adequate sub-field array is such that the light emission time of a more significant bit is provided in a central position. He also reports that it is effective to reduce the display time in one field. He further reports that in experiments, satisfactory display could be realized by providing the light emission time for display in one-fourth of one field and thereby combining this light emission time with the above sub-field array.

Kohgami, in "TV Intermediate Tone Display System Using Memory Type Gas Discharge Panel", EICE Japan, Technical Report, EID 90-9, 1990, reports that the gray scale disturbances can be improved by setting the time interval from the first bit of a field till the last bit of the next field to be within 20 milliseconds, which is the threshold period of merging by human's visual sense. Like the Takigawa's method noted above, it is also reported that the time interval can be set to be within 20 milliseconds for obtaining an improvement in the gray scale disturbances by arranging sub-fields not over the entire field but in a portion of the field on one side thereof. It is further reported that the same condition can be met by arranging a more significant bit of a long light emission time in a split fashion. It is still further reported that, in 8-bit display, the time from the first bit of a field till the last bit of the next field, could be made to be 18.8 milliseconds to improve the gray scale disturbances by splitting the MSB B1 into half sub-fields SF1-1 and SF1-2, splitting the next significant bit B2 into half sub-fields SF2-1 and SF2-2, and forming a sub-field array as one field consisting of 10 sub-fields with the half sub-fields in spaced-apart arrangement such as "SF2-1, SF1-1, SF8, SF7, SF6, SF5, SF4, SF3, SF2-2, SF1-2". In this sub-field array, the hyphenated expression of SF represents half sub-fields, and the numeral after the hyphen represents the order of occurrence in the drive sequence. The non-hyphenated expression of SF represents non-split sub-fields. In the following description, this way of expression is used.

Aside from the above reports, various investigations have been made in order to obtain improvement regarding the gray scale disturbances of moving images with sub-field array optimization. Japanese Laid-Open Patent Publication No. 3-145691 (published on 1991) shows a sub-field array, in which the second and third significant bit sub-fields are arranged on the opposite sides of the MSB sub-field. Japanese Laid-Open Patent Publication No. 7-7702 (published on 1995) shows a sub-field array, in which, unlike the Japanese Laid-Open Patent Publication No. 3-145691 (published on 1991), the second and third significant bit sub-fields are arranged as far apart as possible from the MSB sub-field which is arranged as a central sub-field by arranging sub-fields, which are spaced time-wise from the MSB sub-field, to be adjacent the opposite ends thereof.

The inventors of this invention conducted tests on the above prior art schemes and confirm the effects thereof. It was found that the image quality obtainable with either scheme is insufficient compared to that obtainable with a display using a CRT. For example, the sub-field sequence interchange scheme is not improved so much compared to the simple ascending or descending sequence scheme although it can be readily realized in view of the cost and circuit scale.

Japanese Laid-Open Patent Publication No. 7-175439 shows a scheme, in which the most significant bit sub-field is split into half sub-fields, and a sub-field array of, for instance, "SF8, SF6, SF4, SF1-1, SF2, SF1-2, SF3, SF7" is formed. The same publication also shows splitting the most significant bit sub-field into quarter sub-fields, splitting the second significant bit sub-field into half sub-fields, and forming a sub-field array of, for instance, "SF8, SSP6, SF1-1, SF4, SF2-1, SF1-2, SF3, SF1-3, SF2-2, SF5, SF1-4, SF7". The latter sub-field scheme requires 12 sub-fields. The former sub-field scheme is a generally conceivable one. However, the effect obtainable by splitting the sole most significant bit sub-field is insufficient. Rather, it was confirmed that there are better sub-field arrays than the one with the above limitation. With the latter scheme, it was confirmed that the obtainable effects less in spite of using as many as 12 sub-fields and that it is impossible to obtain sufficient performance even by considerably reducing the time required for the sub-field as a whole.

In the meantime, coding schemes for binary coding with redundancy, other than conventional pure binary coding, have been proposed. For example, Toda et al, "A Modified-Binary-Coded Light-Emission Scheme for Suppressing Cray Scale Disturbances of Moving Images", ASIA DISPLAY '95, S19-9, shows a scheme for suppressing the gray scale disturbances of moving images by making bit carry points unclear with binary coding with redundancy. In this scheme, sub-fields corresponding the most and second significant bits in a usual binary code are each split into half sub-fields, and these four half sub-fields are reconstituted into those of the same weight. Specifically, usually the most and second significant bits with respective weights of 128 and 64 are split into respective weights of 64 and 32, and these four pieces of data are converted to those of the same weight of 48. With this arrangement, it is possible to disperse the bit carry points, which conventionally concentratedly took place at a particular place, to several places. However, this scheme requires dealing with 10-bit data to obtain an accuracy of 8 bits. When it is considered as an actual system, the scheme is not always advantageous because of increases of the cost and circuit scale.

Japanese Laid-Open Patent Publication No. 7-271325 shows a scheme, in which a sub-field array provided for display is bit-by-bit controlled by utilizing coding with redundancy to provide a checkered pattern with alternate appearance of bright and dark gray scale disturbances of moving images. The principle underlying this scheme is to make visual image disturbances less noticeable by utilizing the resolution limit of the eyes, which is imposed when viewing the display panel face from a distant position. Although this scheme is effective, it is subject to bit-by-bit eyesore-like disturbances, which can be noticed when a display involving motion is viewed very carefully. Besides, the use of codes with redundancy results in an actual gradation number reduction compared to the case of perfectly binary codes with the same number of bits used for the display.

The inventors of the present invention further conducted tests concerning the relation between the "threshold merging period" which has heretofore been a fixed concept and gray scales in moving images. A first conceivable scheme is to reduce the sub-field time itself in a sense of providing for an operation close to that of the CRT. This scheme could be tested by providing certain operational conditions. In contrast to the conventional intelligence, gray scale disturbances of moving images could not be sufficiently suppressed from the standpoint of the high display quality even by setting the entire drive sequence time within a considerably short period (of about 4 ms), although this scheme was considerably superior to the purely ascending or descending sequence scheme. With a scheme in which a large number of sub-fields are split like the latter scheme shown in the Japanese Laid-Open Patent Publication No. 7-175439 (published on 1995), the effect which is obtainable by merely splitting sub-fields and adequately arranging the resultant half sub-fields, was insufficient even with a drive sequence time set to meet the above threshold merging period condition.

The typical schemes shown as measures against the gray scale disturbances of moving images in the above literatures and Japanese Laid-Open patent publications, note and cope with more significant bits which are attributable to greater gray scale disturbances of moving images. Certainly, by providing measures with respect to more significant bits, a drastic effect of improvement is obtainable compared to the case when no measure is provided. However, while the conventional measures permit reduction or elimination of great gray scale disturbances of moving images, the effect of improvement can be obtained only up to a certain level. That is, no effect is obtainable with respect to relatively low level disturbances which result in image quality deterioration. The inventors of the present invention could obtain a recognition that it is necessary to take even the disturbances attributable to less significant bits into considerations in order to realize high quality display of moving images.

SUMMARY OF THE INVENTION

The present invention seeks to reduce relatively less gray scale disturbances of moving images attributable to less significant bits, which the prior art scheme did not take into considerations, in addition to suppressing great gray scale disturbances of moving images attributable to more significant bits.

An object of the present invention is to suppress gray scale disturbances of moving images practically sufficiently with a highly practical measure while grasping the whole gradation bits from the most to the least significant one.

Other object of the present invention is to reduce, in a display system for plasma or like display, gray scale or like disturbances of moving images, which poses a problem in sub-field scheme gradation display.

The above object of the present invention is attained with a gradation display method for a display system using sub-field array, which is formed by providing a sub-field corresponding to an m-th (m and n being positive integers of $n \leqq m$, m representing the most significant bit place when m is 1 and n representing number of all gradation bits) bit substantially at the center of the time axis of all the sub-field periods, splitting sub-fields corresponding to two or more bits among the bits other than the m-th significant bit each into paired half sub-fields providing substantially the same light intensity of emission, and providing the splitted paired half sub-fields having the same weights on the opposite sides of the m-th significant bit sub-field substantially in line symmetry with respect to the time axis.

Another gradation display method for a display system according to the present invention uses a sub-field array, in which one or more pairs of non-split sub-fields causing less disturbances are provided as groups of two or more even number on the opposite sides of the close proximity of the m-th significant bit sub-field, the non-split sub-fields in the pair or pairs being position interchanged with respect to the m-th significant bit sub-field for every field.

A further gradation display method for a display system according to the present invention, uses a sub-field array, in which some sub-field other than the m-th significant bit one are each provided as paired half sub-fields in line symmetry with respect to the time axis, at least one pair of half sub-fields consisting of an odd and an even scan line sub-field.

By providing non-split sub-fields substantially centrally in one field period, it is possible to make clear the position relation of sub-fields in the line symmetry arrangement. This has an effect that more (particularly the most) significant bit sub-fields which should be split in common sense in the prior art, need not be split. It will be seen that by providing a non-split sub-field substantially centrally in the field, at least one sub-field can be saved in the sub-field array compared to the prior art while ensuring a comparable effect against gray scale disturbances of moving images.

Principally, the present invention seeks to obtain cancellation of gray scale disturbances of moving images with a symmetrical arrangement of sub-fields. To this end, the paired half sub-fields which are symmetrically arranged, should be provided at positions close to one another in time. In order to cancel disturbances with those of the opposite polarity in a short period of time, the sub-fields which are provided substantially centrally are suitably as short as possible. While the substantially central provision of non-split sub-fields is made to this end, the disturbances that are attributable to these sub-fields may not be taken into considerations so along as they may be considered in relation to the other sub-fields.

For this reason, sub-fields corresponding to more significant bits causing greater disturbances are preferentially provided at positions closer to the central sub-field. In a typical example shown in FIG. 3 to be referred later, the most significant bit sub-field is a non-split sub-field. As for the disturbances attributable to less significant bit sub-fields, these sub-fields are provided nearer the field ends. Since these sub-fields provide less absolute light intensity, the image disturbances caused by them are visually less noticeable. This is based on the consideration that CFF (Critical Flicker Frequency) as a property of human's eyes is increased with increasing light intensity level.

According to the present invention, the arrangement that less significant bit sub-fields are provided as non-split sub-fields on the opposite sides of the close proximity of more significant bit sub-fields and position interchanged for every field, has an aim of cancelling image disturbances. The cancellation effect is obtained in two fields. According to the present invention, a scan line split sub-field scheme is introduced to obtain an effect of cancelling image disturbances between adjacent scan lines. In this case, the image disturbances can be hardly perceived when the display is viewed at a certain distance. Besides, it is possible to greatly save the sub-field sequence time, so that the number of half sub-fields promising an effect of cancelling image disturbances can be increased.

According to the present invention, gray scale disturbances of moving images that are generated in one field, can be substantially cancelled with effects of cancellation between adjacent fields and that between adjacent scan lines.

Other objects and features will be clarified from the following description with reference to attached drawings.

PREFERRED EMBODIMENTS OF THE INVENTION

Figure 1:
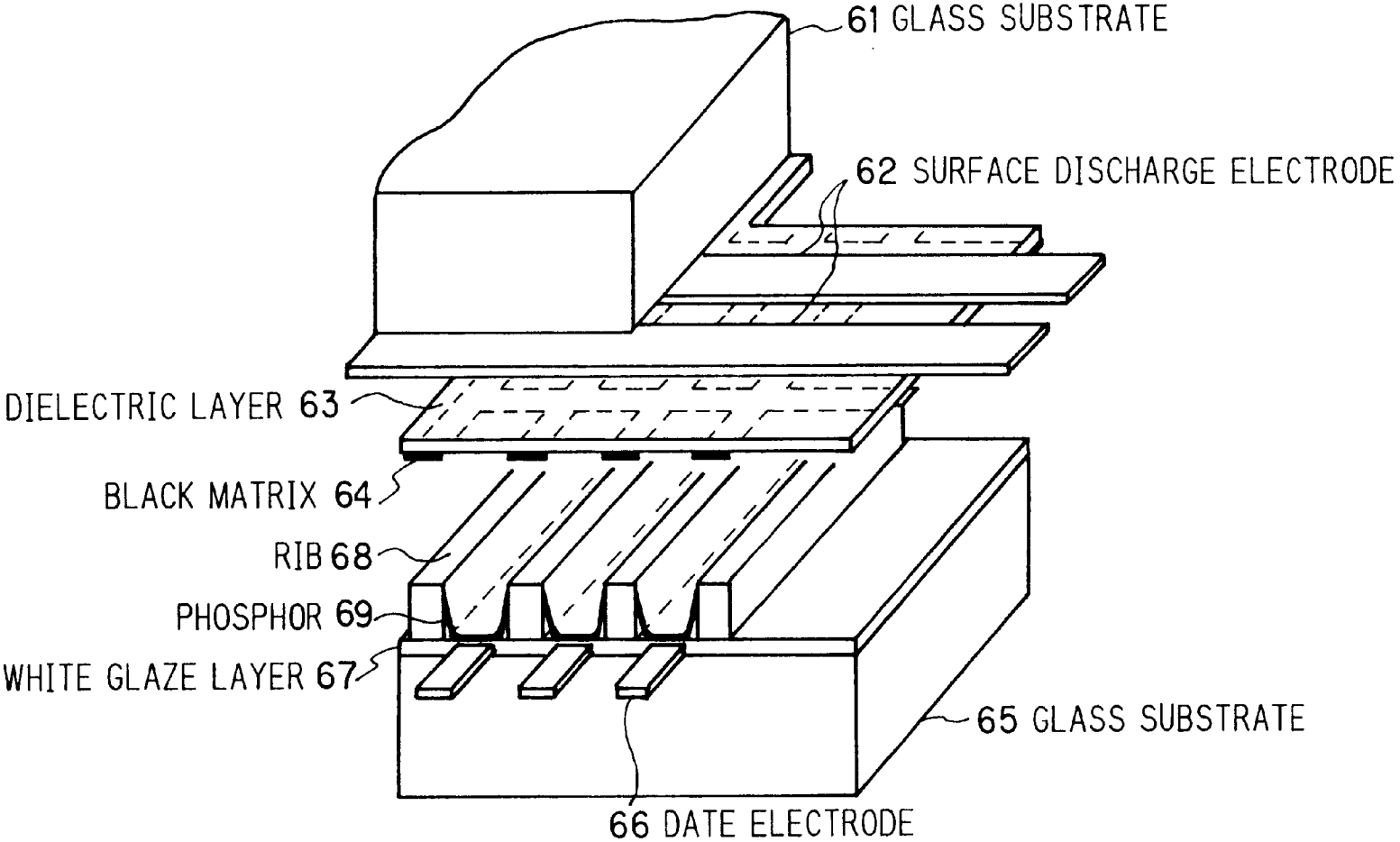
FIG. 1 shows a plasma display panel for a 640×480 color image element display according to the present invention.

FIG. 1 shows a plasma display panel for a 640×480 color image element display, which was fabricated to apply the present invention to it. On a display side glass substrate 61 are provided surface discharge electrodes 62, which are transparent conductive film with laminated metal bus electrodes, and dielectric layer 63, which a magnesium oxide film is bonded to the surface of. On the dielectric layer 63, a lattice-like black matrix 64 is provided to define image elements. On a back side glass substrate 65 are provided data electrodes 66, a white glaze layer 67 and stripes-like white partition walls 68. Phosphors 69 which can emit light of three original colors are coated on predetermined portions of the surfaces of grooves defined between the partition walls 68. A discharge gas composed of He, Ne and Xe is sealed between the two glass substrates, thus completing the panel. Specifically, 1,920 data electrodes 66 are formed, and the surface discharge electrodes 62 comprise 480 scan line electrodes and the same number of sustained emission electrodes.

Figure 2:
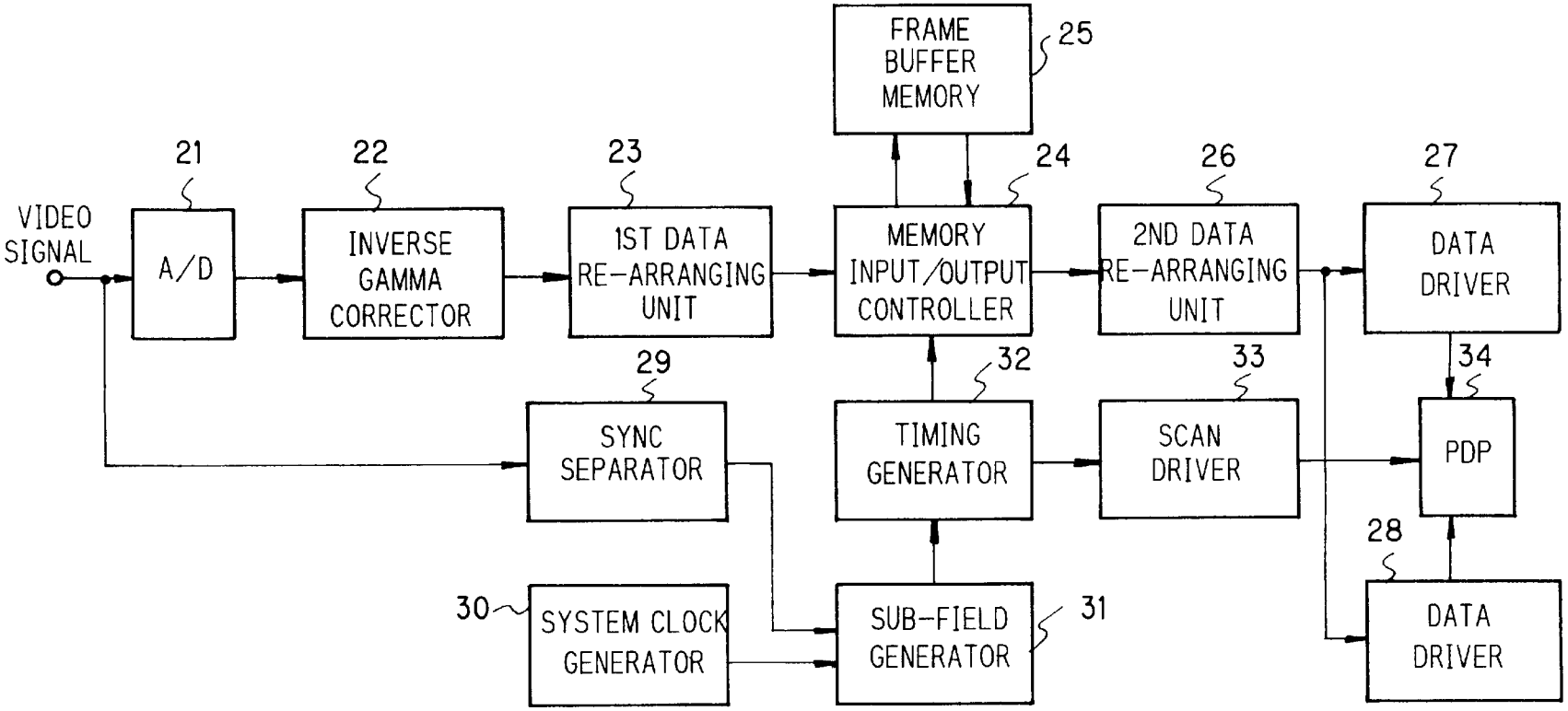
FIG. 2 shows a block diagram showing the flow of video signal in a color PDP used in the embodiment.

FIG. 2 is a block diagram showing the flow of video signal in a color PDP used in experiments. An A/D converter 21 which is provided for each of three, i.e., R, G and B, components of the video signal, quantizes the input video signal. An inverse gamma corrector 22 corrects the luminance data of the quantized video signal. A first data re-arranging unit 23 mixes the R, G and B data into a form to be readily stored in a frame buffer memory 25, and also re-arranges the input data to obtain different addresses for individual gradation bits, the re-arranged data being supplied to a memory input/output controller 24. The memory input/output buffer 24 is an I/O buffer for the read/write control between the frame buffer memory 25 and a first or a second stage. Data representing each gradation bit of the video read out for each sub-field, is supplied through the memory input/output controller 24 to a second data re-arranging unit 26. The second data re-arranging unit 26 re-arranges the input data to be in a final form, which is supplied to two data drivers 27 and 28. A sync signal separator 29 separates sync signals from the video signal, and supplies the vertical sync signal to a sub-field generator 31. The vertical sync signal is used as a reference signal for the entire sub-field sequence. The sub-field generator 31 receives a system clock from a system clock generator 30, and generates a sub-field sequence with reference to the vertical sync signal noted above. A timing generator 32 receives the output of the sub-field generator 31, and supplies a fine timing signal to the memory input/output controller 24 and also a fine timing signal to a scan electrode driver 33. The scan line driver 33 operates for driving the scan electrodes of the PDP 34.

Scan pulses are sequentially applied to the can electrodes except for those corresponding to scan line sub-fields to be described later, and data pulses are applied to the data electrodes which are selected in synchronism to the scan pulses. After this line sequential scan has been made over the entire panel face, sustain discharge is caused thereover for obtaining color emission. Such an operation is carried out in a plurality of sub-fields corresponding to quantized gradation data for one field period of 1/60 second. In this way, motion picture with intermediate gradations is displayed.

For example, for 64-gradation display, six sub-fields SF1 to SF6 are set in correspondence to respective gradation bits from the most significant bit (MSB) B1 to the least significant bit (LSB) B6. In the simplest arrangement of this embodiment, the sub-fields corresponding to the gradation bits from the second significant bit B2 to the least significant bit B6, are each split into half sub-fields. That is, half sub-fields SF2-1 and SF2-2 are provided for the bit B2, half sub-fields SF3-1 and SF3-2 for the bit B3, and so forth up to the bit B6. The number of sustain discharge pulse application times for these half sub-fields is set to substantially one half the number for the sub-fields before being split. Such splitting of a sub-field into half sub-fields can be readily made by, for instance, repeatedly reading out the same gradation data of, for instance, the bit B2 for both the half sub-fields SF2-1 and SF2-2 from the frame buffer memory. The same method may be adopted for the bit B3 and the following bits.

In such a sub-field array of "SF6-1, SF5-1, SF4-1, SF3-1, SF2-1, SF1, SF2-2, SF3-2, SF4-2, SF5-2, SF6-2" in the first embodiment, the emission period of the sub-field SF1 is provided substantially at the center of the field, the half sub-field SF2 are provided adjacent the opposite ends of the sub-field SF1, those of the sub-field SF3 are provided adjacent the outer ends of those of the sub-field SF2, those of the sub-field SF4 are provided adjacent the outer ends of those of the sub-field SF3, and so forth. With such an array, all the gradation bits are at the same light emission centroid position in terms of the time, and every high symmetricity can be ensured.

While this system requires eleven sub-fields, it was confirmed by experiments that the system is greatly effective in that no substantial gray scale disturbances of moving images are observed in effect if the eleven sub-fields are ended in a predetermined period of time in one field period.

For obtaining 256-gradation display under the same principle as above, in a second embodiment, a total of 15 sub-fields are necessary for forming a sub-field array of "SF8-1, SF7-1, SF6-1, SF5-1, SF4-1, SF3-1, SF2-1, SF1, SF2-2, SF3-2, SF4-2, SF5-2, SF6-2, SF7-2, SF8-2". Although the present invention covers such 11-sub-field 64-gradation and 15-sub-field 256-gradation schemes as respective proposals, the schemes using such large numbers of sub-fields are not satisfactory from the standpoints of the cost and the write scan time restrictions. The present invention also proposes a more practical and more effective scheme.

Figure 3:
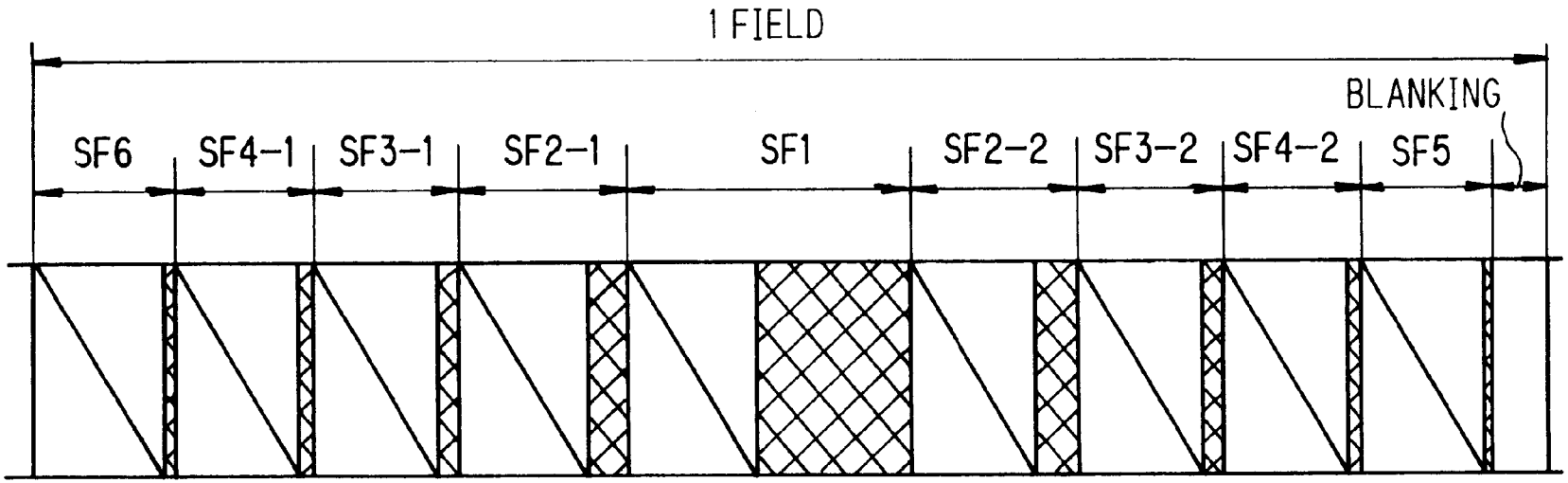
FIG. 3 shows schematical sub-field drive sequence in the embodiment.

Following embodiments of the present invention are proposed to permit readier sub-field driving without splitting less significant bit sub-frames from a practical standpoint. A third embodiment adopts a sub-field array of, for instance, "SF6, SF4-1, SF3-1, SF2-1, SF1, SF2-2, SF3-2, SF4-2, SF5". This sub-field array also provides for great improvement regarding gray scale disturbances of moving images. This is so because it is possible to ensure high line symmetry of arrangement of the sub-fields SF1 to SF4 which govern a great amount of emitted light, while the sub-fields SF5 and SF6 provided adjacent the opposite ends of the array of above sub-fields has an effect of making the differences of the amount of light emitted by the less significant bits to be as small as possible. FIG. 3 schematically shows the sub-field drive sequence in this embodiment. This sequence is based on a discrete scan/sustain discharge type drive scheme, which is utilized for AC memory plasma displays. According to the present invention, however, it is also possible to ensure the symmetricity with drive sequence of a merged scan/sustain discharge type, which is adopted for AC or DC plasma displays irrespective of the sub-field drive scheme.

Figure 4:
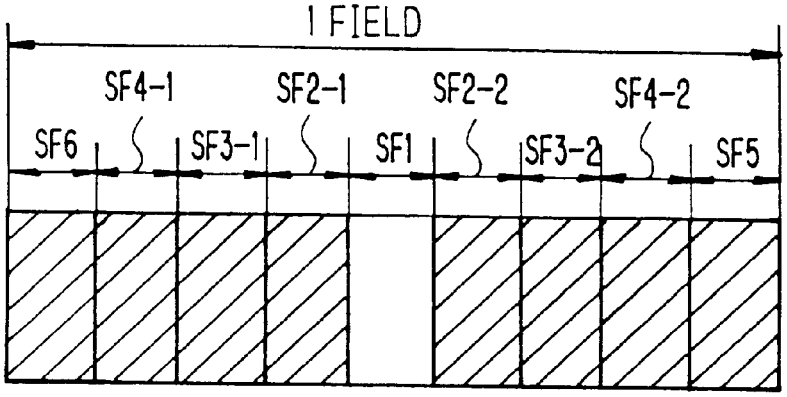
FIGS. 4(A) and 4(B) show the state transition in the display system according to the present invention.
Figure 4:
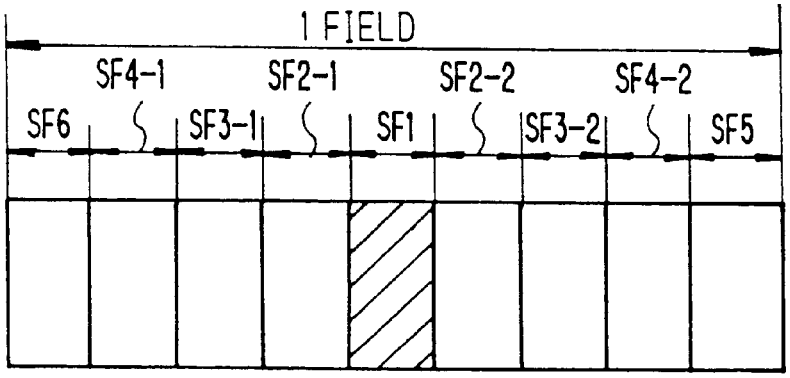
Figure 5:
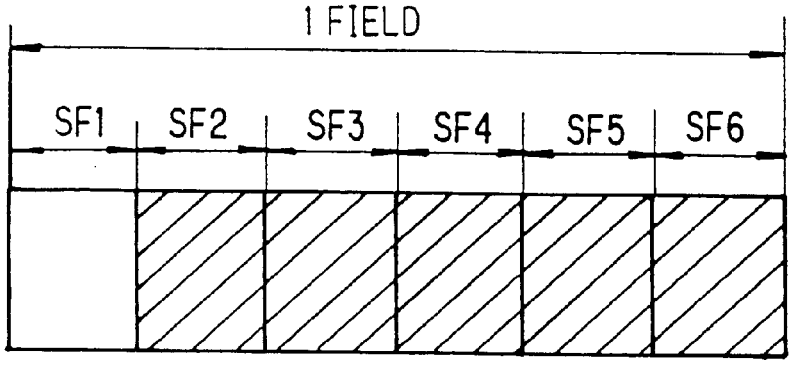
FIGS. 5(A) and 5(B) show the state transition in the display system of a contrast system with a descending sequence sub-field array used in the prior art.
Figure 5:
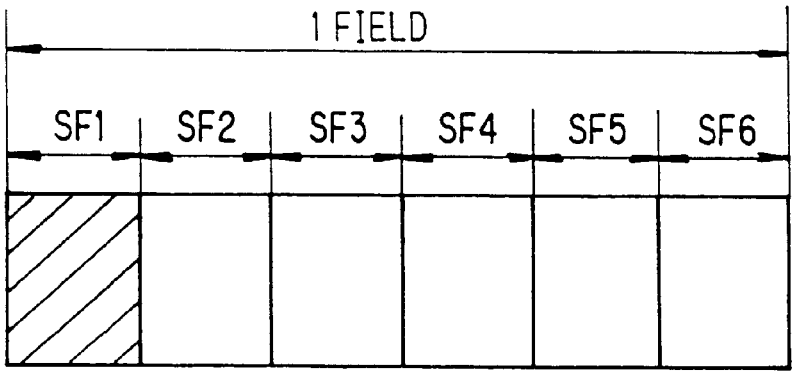
Figure 6:
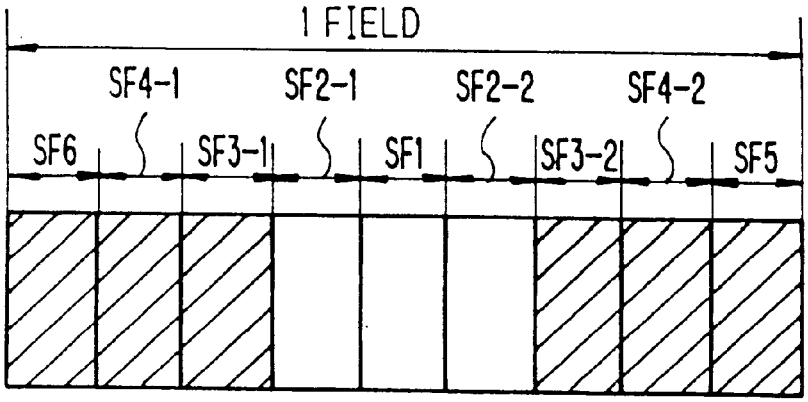
FIGS. 6(A) and 6(B) show the case of a light intensity gradation level change from a 15- to a 16-gradation level.
Figure 6:
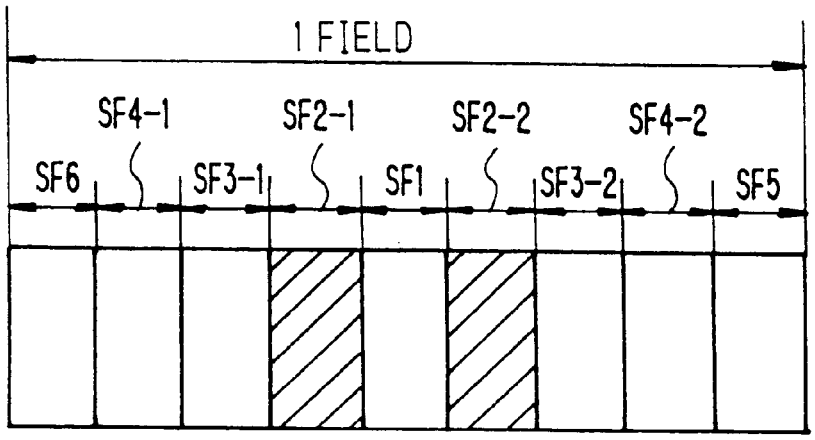

FIGS. 4(A), 4(B), 5(A) and 5(B) show light emission stages of 64-gradation display sub-fields in a light intensity change from a 31- to a 32-gradation level, which is caused with the switching of the MSB which usually causes the greatest cray scale disturbances of moving images. FIGS. 4(A) and 4(B) show the state transition in the display system according to the present invention, and FIGS. 5(A) and 5(B) show that of a contrast system with a descending sequence sub-field array used in the prior art. These figures show, for the sake of brevity, that the individual sub-fields have an equal length and that light is emitted over the entire sub-field period. Actually, however, the individual sub-fields have different lengths. With the sub-field array according to the present invention, the light intensity gradation level change from the 31- to the 32-gradation level, is brought about with a state transition from the state shown in FIG. 4(A), in which the light is emitted by all the bits but the MSB, i.e., the bits on the opposite sides of the MSB, to the state shown in FIG. 4(B), in which light is emitted by the sole central MSB. This state transition is stable with very little lack of uniformity or light emission period differences, and the gray scale disturbances of moving images can be effectively suppressed. It will be seen from FIGS. 5(A) and 5(B) that with the prior art descending sequence sub-field array the sub-fields in the light emission state are greatly displaced in the time axis direction. According to the present invention, the light emission patterns with less disturbances are also obtained in the state transitions other than that of the gradation level change from the 31- to 32-gradation level. FIGS. 6(A) and 6(B) show the case of a light intensity gradation level change from a 15- to a 16-gradation level. This state transition is thought to produce great image disturbances next to those in the case of the state transition from the 31- to the 32-gradation level. At any rate, it will be seen that according to the present invention the sub-fields in the light emission state are distributed in line symmetry with respect to the central non-split bit sub-field as the line of symmetry. FIGS. 6(A) and 6(B), like FIGS. 4(A), 4(B), 5(A) and 5(B), are simplified views.

The scheme according to the present invention, in which the split bits are provided in time axis symmetry with respect to a central non-split bit, is thought to be greatly effective for suppressing the image disturbances, because the disturbances having once caused are canceled in the next moment by a converse sequence sub-field array in line symmetry arrangement in a period within one field. Specifically, when bright (or dark) gray scale disturbances are caused in the first half of one field, dark (or bright) gray scale disturbances are caused by the complementarily arranged second half sub-field sequence. The two types of gray scale disturbances which have opposite characters, are not perceived owing to an integrating effect of person's eyes so long as they are caused at instants relatively close to each other in a short period of time.

As a gray scale disturbance suppression scheme, one which is based on the motion of the light emission centroid, is reported in Kohsaku Toda et al, "Color Disturbances and gray Scale Disturbances in PDP in Moving Image Display", IECE Japan, Technical Report EID 95-136. In its evaluation, the sub-field array of this embodiment is free from substantial motion of the light emission centroid that gives rise to any problem.

In the third embodiment shown in FIG. 3, nine sub-fields are necessary for 64-gradation display. This means that it is necessary to slightly increase the time proportion as the scan time by reducing the sustain discharge period as a whole, or reduce the scan pulse width by providing for more reliable write operation. Unlike the prior art scheme based on increasing the number of sub-fields, however, it is not necessary to split the centrally provided bit. Thus, it is possible to obtain great improvement regarding gray scale disturbances of moving images with only a slight increase of the number of sub-fields, and the embodiment is highly practical.

In a fourth embodiment of the present invention, the number of gradations is expanded to 256 by using a sub-field array of "SF7, SF6, SF4-1, SF3-1, SF2-1, SF1, SF2-2, SF3-2, SF4-2, SF5, SF8". With this arrangement, it is possible to obtain approximately the same effect of suppressing gray scale disturbances of moving images as obtainable in the case of the 64-gradation display. Specifically, the sub-fields SF7 and SF8 may be thought to be additional bits provided adjacent the outer ends of the above line symmetry sub-field array for the 64-gradation display. In this case, unless a high quality effect of suppressing gray scale disturbances is to be obtained, the disturbance level that is attributable to the additional less significant bits is sufficiently low, and the disturbance level attributable to the more significant bits than the additional bits, i.e., the bits which constitute the 64-gradation display sub-field array, is higher.

Figure 7:
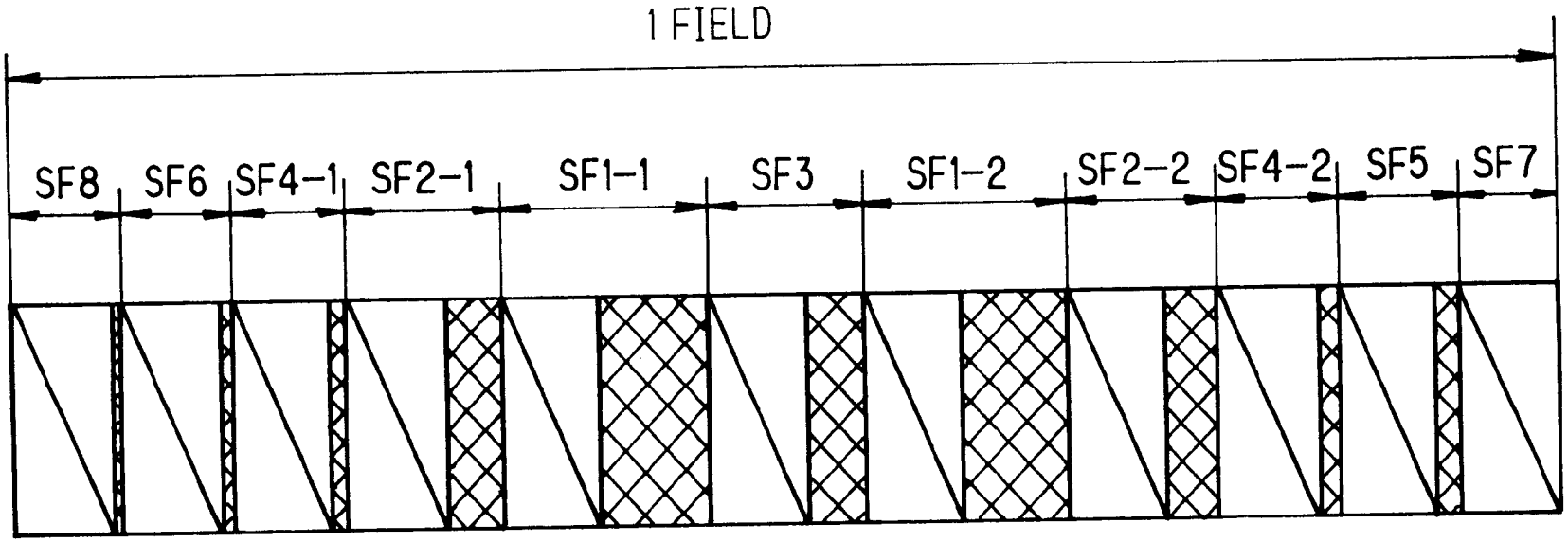
FIG. 7 shows the 256-gradation display sub-field array according to the present invention.

In the above embodiments, the MSB is not split, while three less significant bits are split. According to the present invention, however, it is possible to select one of more significant bits other than the MSB as non-split bit as well as the MSB. A fifth embodiment of the present invention which is applied to 64-gradation display, uses a sub-field array of, for instance, "SF6, SF4-1, SF2-1, SF1-1, SF3, SF1-2, SF2-2, SF4-2, SF5". With this arrangement, satisfactory results can be obtained. Likewise, a sixth embodiment of the present invention which is applied to 256-gradation display, uses a sub-field array of, for instance, "SF8, SF6, SF4-1, SF2-1, SF1-1, SF3, SF1-2, SF2-2, SF4-2, SF5, SF7" to obtain satisfactory results. FIG. 7 shows the 256-gradation display sub-field array. In view of the displayed image, this sub-field array permits more reduction of flicker in high light intensity parts rather than the case of providing the MSB gradation bit sub-field substantially at the center of the array. In plasma display, the array permits reduction of current concentrated in a short period of time, so that it can make the system design easier. While in the above embodiments three bits are split, this is by no means limitative; for instance, it is possible to split only two bits, or all the bits other than the central one may be split.

Further embodiments of the present invention will now be described. More specifically, sub-field arrays will be described, which can improve the image disturbances attributable to the less significant bits as discussed before. For 64-gradation control, a seventh embodiment uses a sub-field array of, for instance, "SF4-1, SF2-1, SF1-1, SF6, SF3, SF5, SF1-2, SF2-2, SF4-2". An eighth embodiment uses a sub-field array in which the MSB is the central non-split bit, such as "SF4-1, SF3-1, SF2-1, SF6, SF1, SF5, SF2-2, SF3-2, SF4-2". With this arrangement, it is possible to reduce gray scale disturbances attributable to the less significant (i.e., the 5-th and 6-th significant) bits. This can be explained from the fact that when the 5-th and 6-th significant bits give rise to gray scale disturbances in relation to more significant bits, the arrangement has an effect of reducing the light emission centroid motion owing to an emitted light amount change of the non-split bit itself, which cannot be expected to have an effect of suppressing the gray scale disturbances attributable to less significant bits. When adopting this scheme, it is important to take into considerations not to collapse the line symmetry of the entire sub-field sequence with respect to the time axis by providing the two less significant bits on the opposite sides of the central sub-field. Specifically, making the times of the sub-fields SF5 and SF6 equal is effective for reducing the light emission centroid motion of the more significant sub-fields. While the above description was made in connection with the 64-gradation display control, in the 256-gradation display control the same effects are obtainable by replacing the sub-fields SF5 and SF6 with the sub-fields SF7 and SF8, respectively. In the 256-gradation case, the four bits corresponding to the sub-fields SF5 to SF8 may be collectively replaced with the sub-fields SF5 and SF6.

Figure 8:
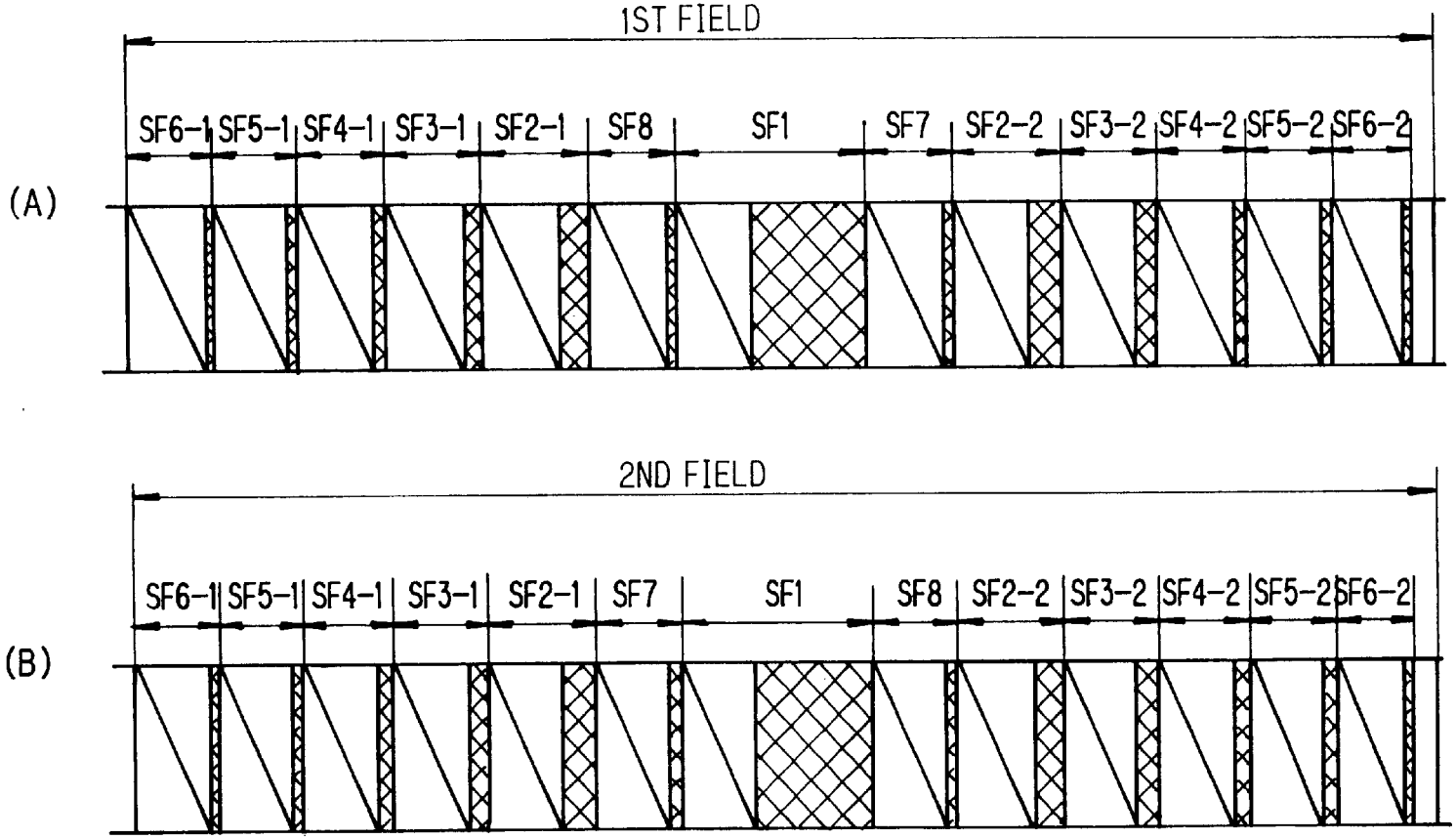
FIGS. 8(A) and 8(B) show the sub-field array for the first field and second field.

As a further feature of the present invention, the positions of the sub-fields on the opposite sides of the central sub-field are interchanged for every field. As an embodiment applied to the above 64-gradation display control, the positions of the sub-fields SF5 and SF6 are interchanged for every field. For example, a ninth embodiment of the present invention uses, for a first field, a sub-field array of "SF4-1, SF3-1, SF2-1, SF6, SF1, SF5, SF2-2, SF3-2, SF4-2" and, for a second field, a sub-field array of "SF4-1, SF3-1, SF2-1, SF5, SF1, SF6, SF2-2, SF3-2, SF4-2". As an embodiment applied to the above 256-gradation display control, the positions of the sub-fields SF7 and SF8 are interchanged for every field. For example, a tenth embodiment of the present invention uses, for a first field, a sub-field array of "SF6-1, SF5-1, SF4-1, SF3-1, SF2-1, SF8, SF1, SF7, SF2-2, SF3-2, SF4-2, SF5-2, SF6-2" and, for a second field, a sub-field array of "SF6-1, SF5-1, SF4-1, SF3-1, SF2-1, SF7, SF1, SF8, sf2-2, SF3-2, SF4-2, SF5-2, SF6-2". FIGS. 8(A) and 8(B) show these sub-field arrays for the two successive fields, i.e., FIG. 8(A) shows the sub-field array for the first field, and FIG. 8(B) shows that for the second field. The absolute light intensity level in charge of the sub-fields SF7 and SF8, the positions of which are interchanged for the 256-gradation control as shown in FIGS. 8(A) and 8(B), is considerably low. It was proved by experiments that with this arrangement the flicker level attributable to the interchanged sub-fields can not be substantially perceived.

In the 256-gradation display control case, it is possible to arrange for interchanging the positions of all the sub-fields corresponding to four bits from the least significant one. For example, an eleventh embodiment of the present invention uses, for a first field, a sub-field array of "SF4-1, SF3-1, SF2-1, SF8, SF6, SF1, SF5, SF7, SF2-2, SF3-2, SF4-2" and, for a second field, a sub-field array of "SF4-1, SF3-1, SF2-1, SF7, SF5, SF1, SF6, SF8, SF2-2, SF3-2, SF4-2".

With the field-by-field sub-field position interchange, the gray scale disturbances of moving images in, for instance, 64-gradation display that are attributable to the sub-fields SF6 and SF5, alternately appear as bright and dark ones for every field, and are thus cancelled in a period of at least two fields. This cancelling effect may be relatively easily and intuitively understood from the facts that human's eyes have a character of following after moving images and that the disturbances that appear are moved synchronously. The field-by-field position interchange sub-fields are provided near the center of the sub-field sequence as a whole. This is done so in order to suppress as much as possible relatively noticeable flicker of a component at one half the field frequency. For the same reason, in the 256-gradation display control embodiment in which the positions of the sub-fields corresponding to the four successive bits from the least significant one are interchanged, relatively heavy bits among the less significant ones, such as those corresponding to the sub-fields SF5 and SF6, are provided closer to the center position. According to the present invention, the positions of only less significant bit sub-fields are interchanged for every sub-field. This is so because of the fact that causing position interchange of more significant bit sub-fields, makes the above flicker of the component at one half the field frequency noticeable, and therefore is not practical.

It will be appreciated that a great effect of improvement regarding gray scale disturbances of moving images, is obtainable with such a sub-field sequence as to provide symmetricity in one field of split sub-fields with respect to more significant bit sub-fields by split sub-fields, while effecting field-by-field position interchange less significant bit sub-fields. In effect, disturbances are thus cancelled in two fields. In the above 64-gradation display control embodiment, the sub-field sequence can be realized with nine sub-fields. It was confirmed by experiments that this scheme permits substantially perfect suppression of gray scale disturbances of moving images provided the overall sub-field sequence time is held within a predetermined time. Moreover, further sub-field saving can be attained by making a total of four bits to be those corresponding to the position interchange sub-fields even in the 64-gradation display. A twelfth embodiment of the present invention applied to the 64-gradation display, uses only a total of seven sub-fields, i.e., uses, for a first field, a sub-field array of "SF2-1, SF6, SF4, SF1, SF3, SF5, SF2-2" and, for a second field, a sub-field array of "SF2-1, SF5, SF3, SF1, SF4, SF6, SF2-2". In this case, the flicker of the component at one-half the field frequency is increased compared to the above 9-sub-field case because of the field-by-field position interchange of considerably large light intensity ratio bit sub-fields. In application to an actual display system, therefore, a measure is necessary for reducing the sub-field sequence time of one field.

Further embodiments of the present invention will now be described, which permit great saving of the sub-field sequence time. As described before, according to the present invention very satisfactory display can be realized by increasing the number of split sub-fields, i.e., paired half sub-fields, as a measure against gray scale disturbances of moving images. However, with a trend for increasing display capacity or screen size of PDP, it is difficult from the standpoint of the sub-field driving to increase the total number of sub-fields in one field. In the AC surface discharge type plasma display embodying the present invention, data is written by generating a write discharge between scan and data electrodes and thus forming a barrier charge image corresponding to a display pattern. Reliable write discharge generation and sufficient barrier charge image formation require somewhat long pulse application times, although this is dependent on drive manner contrivance. At present, it is suitable to ensure a write pulse width of about 3 microseconds, if possible. Where the sub-fields corresponding to the second significant bit B2 and all the less significant bits are all split as described before in connection with the first embodiment of the present invention, 15 sub-fields are necessary for 256 gradations as required for the TV display. Assuming a 480-line drive case, with a write time of 3 $\mu$s per line only the total write time is 21.6 ms, which is longer than one field time of 16.7 ms in the usual TV display. In this case, the write drive is impossible. One field time should include the sustain discharge time and also various control pulse application times. Considering the write drive capacity of the actual PDP, therefore, it is impossible in many cases to simply increase the number of sub-fields.

According to the present invention, resort is had to the visual sense property for suppressing gray scale disturbances of moving images and securing write time at a time by increasing half sub-field pairs in effect. A gist of the present invention resides in splitting some intrinsic sub-fields each into half sub-fields, which consist of scan lines that are equal in number but different in positions, and arranging the half sub-fields as a pair in symmetrical positions. For example, in one of paired half sub-fields data is written for only the odd line image elements to sustain the light emission, while in the other half sub-field data is written for only the even scan line image elements. With this arrangement, the write time is not increased by the sub-field splitting. The half sub-fields obtained as a result of the sub-field splitting in the above way, are called scan line split sub-fields. On the other hand, the half sub-fields that are described before, in which data is written over the entire panel face for light emission at one half the light intensity of emission in the case of the non-split sub-field, are called sustaining period split sub-fields. In the scan line split sub-field, the number of scan lines for writing data therein is reduced to one half compared to the non-slit sub-field, and this means that the write time is also reduced to one half. In the sustaining period split sub-field, on the other hand, although the sustain discharge time may be reduced to one half, the necessary write time is the same as in the non-split sub-field. In TV or computer display where a large number of scan lines are used, in a multiple gradation display the write time occupies a major proportion of one field period. For this reason, the scan line split sub-fields may be advantageously used for improvement regarding gray scale disturbances of moving images.

A thirteenth embodiment of the present invention uses a sub-field array, which adopts the above scheme entirely, such as "SF8-E, SF7-O, SF6-E, SF5-O, SF4-E, SF3-O, SF2-E, SF1, SF2-O, SF3-E, SF4-O, SF5-E, SF6-O, SF7-E, SF8-O". In this sub-field array, the non-split sub-field SF1 is provided substantially at the center of the field for full line data writing and full light intensity sustain discharge. The second bit B2 and following significant bit sub-fields are each split into an even and an odd line display half sub-line as a pair, and these paired scan line split sub-fields are arranged at symmetrical positions with respect to the sub-field SF1. The expressions "-E" and "-O" provided after the SF No. indicate that the pertinent half sub-fields are an even and an odd scan line split sub-field, respectively. The SF expression without any hyphen indicates a non-split sub-field.

The scan line split sub-field requires only one half the full line write time. Thus, although the above sub-field array consists of 15 sub-fields, its write time is the same as in the 8-sub-field drive case. In this sub-field array, the field SF1 which is provided at the center need not be split. This has advantages that it is possible to save the sustain discharge time of the sub-field SF1 and also that adverse effects of the sub-field splitting into even and odd scan line sub-fields can be avoided in the highest light intensity sub-field. In this embodiment, the sustain discharge time is double that of the sub-fields SF2 to SF8, but its increase is at most 2 ms. At any rate, the write time reduction that is obtainable is very advantageous. In this scheme, the time-wise splitting of sub-fields into even and odd scan line sub-fields results in symmtetricity deterioration, thus resulting in appearance of very subtle gray scale disturbances of moving images (i.e., appearance of alternate subtle bright and dark gray scale disturbances for every line) or a slight sense of disturbance such as a sense of flicker in special patterns such as very fine stripes patterns. In usual TV video, however, such slight image disturbances give rise to no problem.

Figure 9:
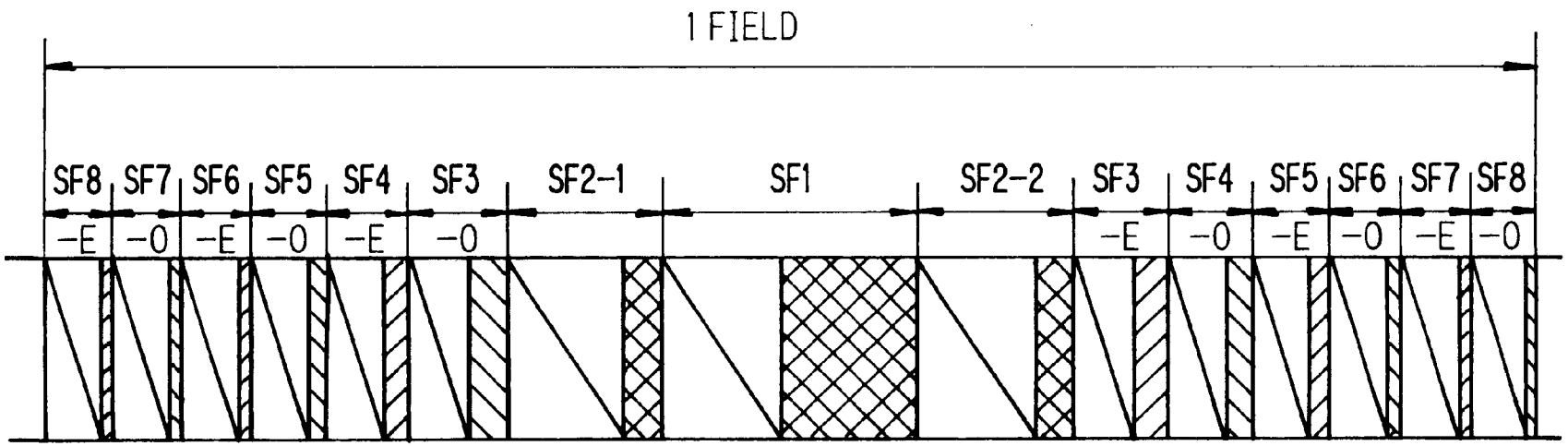
FIG. 9 shows a sub-field array according to other embodiment of the present invention.
Figure 10:
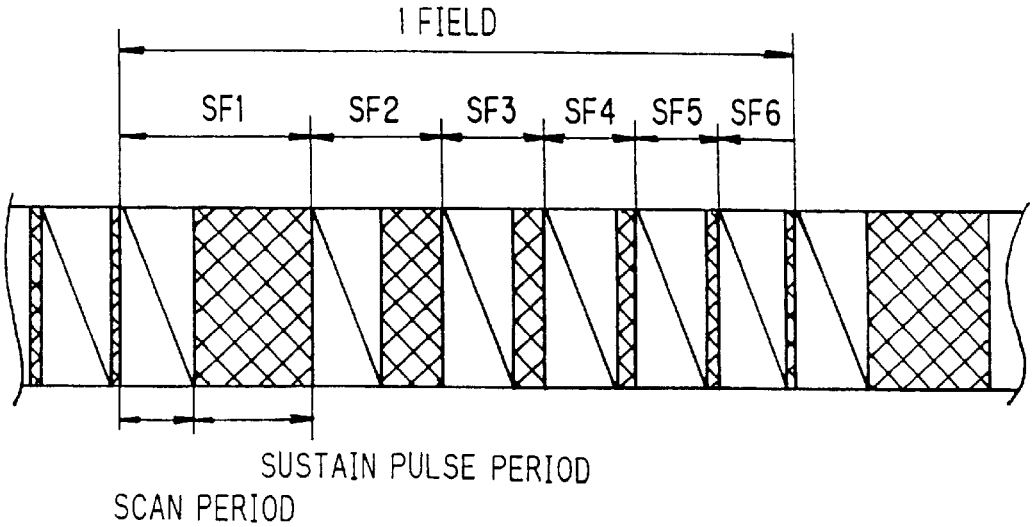
FIGS. 10(A) and 10(B) show sub-field scheme display of a discrete scan/sustain discharge drive type according to the present invention.
Figure 10:
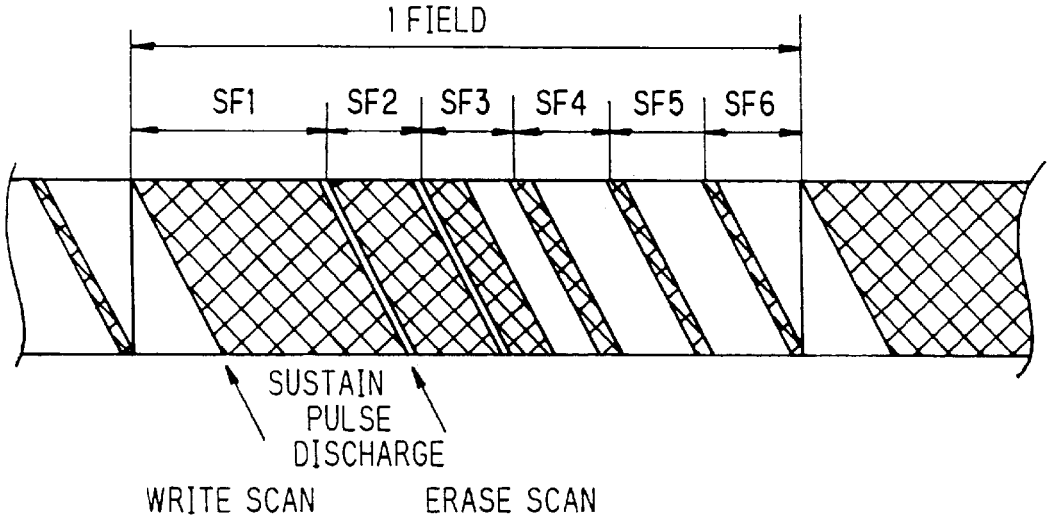

As a development of the above scheme, although the total write time is slightly increased, it is possible to split more significant bit sub-fields into the sustaining period split sub-fields, while splitting less significant bit sub-fields into scan line split sub-fields. A fourteenth embodiment of the present invention uses a sub-field array of, for instance, "SF8-E, SF7-O, SF6-E, SF5-O, SF4-E, SF3-O, SF2-1, SF1, SF2-2, SP3-E, SF4-O, SF5-E, SF6-O, SF7-E, SF8-O" as shown in FIG. 9. This sub-field array permits 75% light intensity of emission to be obtained over the full panel face, while substantially eliminating adverse effects of time deviation between the even and odd scan line displays. It is of course possible to split the sub-fields SF3 and SF4 as well into sustaining period split sub-fields instead of the scan line split sub-fields. However, doing so leads to a write time increase demerit, although being effective for improvement in the gray scale disturbances of moving images because of low light intensity of emission of these gradation bits. In general, the sub-field array to be adopted may be determined in dependence on the display design.

In the above embodiments, higher light intensity, i.e., more significant bit, sub-fields are provided near the center of the sub-field array. From the standpoint of suppressing the gray scale disturbances of moving images, it is suitable to concentratedly provide higher light intensity sub-fields in the neighborhood of the sub-field array center. Particularly, more satisfactory results are obtainable by providing the field SF1 at the center. Generally, it is possible to split the sub-field SF1 as well and provide the half sub-fields thereof in symmetrical positions in order to attach importance to the suppression of high light intensity flicker, which is subject to ready perception in case when the high light intensity parts are displayed in a large area even at the Japan US system TV standard field frequency of 60 Hz which is thought to be a high frequency. A fifteenth embodiment of the present invention uses a sub-field array of, for instance, "SF8-E, SF7-O, SF6-E, SF5-O, SF1-1, SF4-E, SF3-O, SF2, SF3-E, SF4-O, SF1-2, SF5-E, SF6-O, SF7-E, SP8-O". In this sub-field array, the highest light intensity sub-field is provided as spaced-apart half sub-fields for high light intensity flicker reduction or elimination. In this embodiment, the sub-field SF1 is split into sustaining period split sub-fields because of the facts that the sub-field SF1 has far long sustain discharge time compared to the other sub-fields, rather longer than the full line write time, and that somewhat superior display quality is obtainable in the case of the sustaining period split sub-fields rather than the scan line split sub-fields. Such a sub-field array is particularly effective in the case of the European system TV standard frequency, which is as low as 50 Hz.

The less significant bit sub-fields, particularly the least significant bit one, provide low light intensity of emission, having less adverse effects on the display, so that they may not be split into paired half sub-fields. A sixteenth embodiment of the present invention is free from the splitting of, for instance, the sub-field SF8 corresponding to the least significant bit B8, that is, it uses a sub-field array of "SF8, SF7-O, SF6-E, SF5-O, SF4-E, SF3-O, SF2-1, SF1, SF2-2, SF3-E, SF4-O, SP5-E, SF6-O, SF7-E".

In case of being free from the splitting of less significant bit sub-fields, it is possible to adopt the scheme of cancelling gray scale disturbances in two consequent fields. A seventeenth and an eighteenth embodiment of the present invention are examples of this scheme, using a sub-field array of "SF6-E, SF5-O, SF4-E, SF3-O, SF2-1, SF7, SF1, SF8, SF2-2, SF3-E, SF4-O, SF5-E, SF6-O" and that of "SF8, SF5-O, SF4-E, SF3-O, SF2-1, SF6, SF1, SF7, SF2-2, SF3-E, SF4-O, SF5-E", respectively. In the former embodiment, the positions of the sub-fields SF7 and SF8 are interchanged for every field. In the latter embodiment, the positions of the sub-fields SF6 and SF7 are interchanged. The adverse effects of the less significant bit sub-fields thus can be cancelled. From the standpoint of the flicker elimination, the non-split sub-fields for field-by-field position interchange are suitably provided at positions as close to the center as possible.

It is possible to combine non-split sub-fields corresponding to less significant bits and half sub-fields of the sub-field SF1. A nineteenth embodiment of the present invention uses a sub-field array of, for instance, "SF6-E, SF5-O, SF4-E. SF3-O, SF1-1, SF7, SF2, SF8, SF1-2, SF3-E, SF4-O, SF5-E, SF6-O", with the sub-fields SF7 and SF8 being position interchanged for every field.

In the above sub-field arrays, the odd and even scan lines are displayed alternately in order to minimize the adverse effects of sub-field splitting into odd and even ones by providing for as random sub-field array as possible. In dependence on signal processing or the like, it is possible to collect odd sub-fields in the first half of the field and even sub-fields in the in the second half without spoiling the basic effects of the invention.

While the above embodiments have concerned with the 8-bit 256-gradation display, the scheme according to the present invention is directly applicable to other gradation displays such as 8, 7 or 10 bits. In addition, while the above embodiments have concerned with the splitting of a sub-fields into pared scan line split sub-fields, i.e., an even and an odd scan line panel face sub-field, which consist of every other scan lines, in dependence on signal processing or drive circuit, it is also possible to split a sub-field into those which consists of every third scan lines, although the display performance is slightly sacrificed.

In the above embodiments, three different write modes, i.e., the full line, odd line and even line write modes, are set in dependence on the sub-field. It is thus possible to realize PDP gradation display drive in the scheme according to the present invention without possibility of particular trouble by adopting data read control or scan pulse control in dependence on the sub-field array. The odd or even scan line display is light in the sustain discharge load compared to in the case of the full panel face display, thus permitting reduction of the sustain discharge pulse width or cycle to reduce the entire sustain discharge period.

As has been shown, with the scheme according to the present invention the write time is less increased. As an example, even where the write time necessary for one line is about 3 $\mu$s, a 256-gradation display free from the gray scale disturbances of moving images is obtainable with a 480-line display panel. By also adopting the two-divided panel face scan drive in combination it is possible to obtain high resolution, large gradation number display such as HDTV or SXGA with the write pulses of about 3 $\mu$s.

A twentieth embodiment of the present invention is one, in which at least one pair of scan line split sub-fields are position interchanged for every field. Taking the previous fifteenth embodiment as a basis, the embodiment uses, for instance, for a first embodiment, a sub-field array of "SF8-E, SF7-O, SF6-E, SF5-O, SF1-1, SF4-E, SF3-O, SF2, SF3-E, SF4-O, SF1-2, SF5-E, SF6-O, SF7-E, SF8-O" and, for a second field, a sub-field array of "SF8-O, SF7-E, SF6-E, SF5-O, SF1-1, SF4-E, SF3-O, SF2, SF3-E, SF4-O, SF1-2, SF5-E, SF6-O, SF7-O, SF8-E". In this embodiment, the sub-fields SF7-O and SF8-E and the sub-fields SF8-E and SF8-O are position interchanged with one another for every field. This arrangement is effective for preventing inter-line coupling of gray scale disturbances generated in moving images when a motion of subject at a predetermined speed in the longitudinal direction is followed by the viewer's eyes. This means that it is desirable to extend the field-by-field position interchange half sub-fields to as significant bits as possible. Doing so, however, leads to a more serious flicker problem. In many actual cases, therefore, they are applied to less significant bits. With the field-by-field position interchange of half sub-fields, however, flicker that is generated is light compared to the case of field-by-field position interchange of non-split sub-fields. In this connection, like the other embodiments described before it is of course possible to an optimum combination of sustaining period split sub-fields and non-split sub-fields.

While the above embodiments of the present invention have concerned with the face discharge type AC plasma display driving in separate scan and sustain discharge times, the scheme according to the present invention is also applicable to other drive systems or to AC plasma displays of other configurations such as orthogonal two-electrode type or DC plasma displays so long as the sub-field scheme gradation display is adopted. Also, the present invention is applicable not only to the PDP but is similarly effective for ferro-dielectric liquid crystal or like displays, which adopts the sub-field scheme gradation display. Moreover, while the above description of the embodiments has concerned with binary-code-weighted gradation bits because these bits permit a large number of gradations to be reproduced with a small number of bits and are thus suited to the scheme according to the present invention, the concept of the present invention is also effective for cases where other modified gradation bit codes are used.

As has been described in the foregoing, the present invention permits great improvement regarding gray scale disturbances of moving images, which pose a problem in sub-field scheme gradation display systems for they cause eyesores and deteriorate the image quality. The gradation display scheme according to the present invention permits realization of full color multiple gradation moving image display of satisfactory image quality in a large display panel TV or full color computer display as plasma display with less additional cost. The scheme according to the present invention is applicable not only to the plasma display but also to other displays adopting the sub-field scheme for gradation display.

Changes in construction will occur to those skilled in the art and various apparently different modifications and embodiments may be made without departing from the scope of the present invention. The matter set forth in the foregoing description and accompanying drawings is offered by way of illustration only. It is therefore intended that the foregoing description be regarded as illustrative rather than limiting.

What is claimed is:

1. A gradation display method in a display system, comprising forming a sub-field array by providing a sub-field corresponding to the most significant bit sub-field substantially at the center of the period of all sub-fields, splitting one or more sub-fields corresponding to less significant bits lower than the most significant one each into paired half sub-fields providing substantially the same light intensity of emission, and providing the paired sub-fields on the opposite sides of the most significant bit sub-field substantially in line symmetry with respect to the time axis.

2. The gradation display method in a display system according to claim 1, wherein two sub-fields among sub-fields corresponding to non-split bits other than the most significant bit are provided on the opposite sides of the close proximity of the most significant bit.

3. The gradation display method in a display system according to claim 2, wherein while two significant bit sub-fields among non-split significant bit sub-fields other than the most significant bit are provided on the opposite sides of the close proximity of the most significant bit sub-field, their positions are interchanged with respect to the substantially central most significant bit sub-field as for every field.

4. The gradation display method for a display system according to claim 3, wherein the paired half sub-fields providing substantially the same light intensity of emission are sustaining period split sub-fields providing substantially the same light intensity of emission as a result of division of the number of times of sustained emission.

5. The gradation display system according to claim 3, which is a gradation display method for plasma display, and in which paired half sub-fields providing substantially the same light intensity of emission are scan line split sub-fields for causing light emission from image elements on scan lines which are equal in number but different in positions.

6. The gradation display method for plasma display according to claim 5, wherein first and second halves of one or more pairs of scan line split sub-fields providing substantially the same light intensity of emission are position interchanged for every field.

7. The gradation display system according to claim 3, which is a gradation display method for plasma display, and in which paired sub-fields providing substantially the same light intensity of emission, consist of a sustaining period split sub-field and a scan line split sub-field.

8. The gradation display method for a plasma display according to claim 7, wherein the more significant bit split sub-field of the paired split sub-fields providing substantially the same light intensity of emission is a sustaining period split sub-field, while the less significant bit one is a scan line split sub-field.

9. The gradation display method for plasma display according to claim 8, wherein first and second halves of one or more pairs of scan line split sub-fields providing substantially the same light intensity of emission are position interchanged for every field.

10. The gradation display method for plasma display according to claim 7 wherein first and second halves of one or more pairs of scan line split sub-fields providing substantially the same light intensity of emission are position interchanged for every field.

11. The gradation display method for a display system according to claim 2, wherein the paired half sub-fields providing substantially the same light intensity of emission are sustaining period split sub-fields providing substantially the same light intensity of emission as a result of division of the number of times of sustained emission.

12. The gradation display system according to claim 2, which is a gradation display method for plasma display, and in which paired half sub-fields providing substantially the same light intensity of emission are scan line split sub-fields for causing light emission from image elements on scan lines which are equal in number but different in positions.

13. The gradation display method for plasma display according to claim 12, wherein first and second halves of one or more pairs of scan line split sub-fields providing substantially the same light intensity of emission are position interchanged for every field.

14. The gradation display system according to claim 2, which is a gradation display method for plasma display, and in which paired sub-fields providing substantially the same light intensity of emission, consist of a sustaining period split sub-field and a scan line split sub-field.

15. The gradation display method for a plasma display according to claim 14, wherein the more significant bit split sub-field of the paired split sub-fields providing substantially the same light intensity of emission is a sustaining period split sub-field, while the less significant bit one is a scan line split sub-field.

16. The gradation display method for plasma display according to claim 15, wherein first and second halves of one or more pairs of scan line split sub-fields providing substantially the same light intensity of emission are position interchanged for every field.

17. The gradation display method for plasma display according to claim 14, wherein first and second halves of one or more pairs of scan line split sub-fields providing substantially the same light intensity of emission are position interchanged for every field.

18. The gradation display method in a display system according to claim 1, wherein said sub-field corresponding to the most significant bit sub-field is centered within the period of all sub-fields.

19. The gradation display method for a display system according to claim 1, wherein the paired half sub-fields providing substantially the same light intensity of emission are sustaining period split sub-fields providing substantially the same light intensity of emission as a result of division of the number of times of sustained emission.

20. The gradation display system according to claim 1, which is a gradation display method for plasma display, and in which paired half sub-fields providing substantially the same light intensity of emission are scan line split sub-fields for causing light emission from image elements on scan lines which are equal in number but different in positions.

21. The gradation display method for plasma display according to claim 20, wherein first and second halves of one or more pairs of scan line split sub-fields providing substantially the same light intensity of emission are position interchanged for every field.

22. The gradation display system according to claim 1, which is a gradation display method for plasma display, and in which paired sub-fields providing substantially the same light intensity of emission, consist of a sustaining period split sub-field and a scan line split sub-field.

23. The gradation display method for a plasma display according to claim 22, wherein the more significant bit split sub-field of the paired split sub-fields providing substantially the same light intensity of emission is a sustaining period split sub-field, while the less significant bit one is a scan line split sub-field.

24. The gradation display method for plasma display according to claim 23, wherein first and second halves of one or more pairs of scan line split sub-fields providing substantially the same light intensity of emission are position interchanged for every field.

25. The gradation display method for plasma display according to claim 22, wherein first and second halves of one or more pairs of scan line split sub-fields providing substantially the same light intensity of emission are position interchanged for every field.

* * * * *